US006067434A

United States Patent [19]

Takagi et al.

[11] Patent Number: 6,067,434

[45] Date of Patent: May 23, 2000

[54] DEVELOPING ROLLER AND DEVELOPING APPARATUS

[75] Inventors: Koji Takagi, Kawasaki; Yoshio Takizawa, Fussa; Tokuo Okada; Hiroshi Kaneda, both of Kodaira; Koichi Iwami, Tachikawa, all of Japan

[73] Assignee: Bridgestone Corporation, Tokyo, Japan

[21] Appl. No.: 09/106,287

[22] Filed: Jun. 29, 1998

[30] Foreign Application Priority Data

Jun. 27, 1997 [JP] Japan ..... 9-187577

[51] Int. Cl.[7] ..... G03G 15/08

[52] U.S. Cl. ..... 399/286; 492/56

[58] Field of Search ..... 399/265, 279, 399/285, 286; 492/56, 59

[56] References Cited

U.S. PATENT DOCUMENTS

| | | | |
|---|---|---|---|
| 4,958,193 | 9/1990 | Nojima et al. | 399/286 |
| 4,990,963 | 2/1991 | Yamamoto et al. | 399/286 |
| 5,286,917 | 2/1994 | Unno et al. | 399/279 |
| 5,557,060 | 9/1996 | Okada et al. | 399/285 X |
| 5,697,027 | 12/1997 | Takagi et al. | 399/279 |
| 5,903,808 | 5/1999 | Takizawa et al. | 399/286 |

FOREIGN PATENT DOCUMENTS

| | | |
|---|---|---|
| 8-73660 | 3/1996 | Japan . |
| 8-328351 | 12/1996 | Japan . |
| 9-171299 | 6/1997 | Japan . |

*Primary Examiner*—Fred L. Braun

*Attorney, Agent, or Firm*—Sughrue, Mion, Zinn, Macpeak & Seas, PLLC

[57] ABSTRACT

A developing roller supports a one-component developer on a surface thereof in the form of a thin layer, and is brought in contact with or in proximity to an image forming body in such a state, to supply the developer on a surface of the image forming body, thereby allowing a visible image to be formed on the surface of the image forming body. The developing roller includes: an elastic layer having an ionically conductivity whose surface is imparted with a resin component having a high resistivity. Thus, if R1 is a resistance of the roller in a stationary state and R2 is a resistance of the roller in a rotational state, a relationship of R1>R2 is established. With this developing roller, it is possible to obtain a high quality image and a high gradient.

20 Claims, 3 Drawing Sheets

DEVELOPING ROLLER AND DEVELOPING APPARATUS

BACKGROUND OF THE INVENTION

The present invention relates to a developing roller which is, in an electrophotographic system or a electrostatic recording system such as a copying machine or a printer, used for supplying a one-component developer on an image forming body represented by a photosensitive drum or belt for holding an electrostatic latent image, or a sheet of paper, transparency, or photographic paper, thereby allowing a visible image to be formed on a surface of the image forming body. It specifically related; and; to a developing apparatus using the developing roller. In particular, the present invention relates to a developing roller capable of obtaining a high quality image without the occurrence of an uneven image density and/or a background fogged image and of attaining a high gradient, and to a developing apparatus using the developing roller.

In an electrophotographic system or an electrostatic recording system such as a copying machine or a printer, as a developing method for supplying a one-component developer on a latent image support such as a photosensitive drum for supporting a latent image, to stick the developer on the latent image formed on a surface of the latent image support, thereby visualizing the latent image, a pressing type developing method has been known, for example, from U.S. Pat. Nos. 3,152,012 and 3,731,146. This method is advantageous in facilitating simplification and miniaturization of the developing apparatus and also facilitating coloring of toner because of no need of using a magnetic material.

In this pressing type developing method, a developing roller for supporting toner (generally, composed of a non-magnetic one-component developer) is brought in contact with a latent image support such as a photosensitive drum for supporting an electrostatic latent image, to stick the toner on the latent image formed on the latent image support, thereby allowing the latent image to be developed. Accordingly, the developing roller used for this method is required to be formed of an elastic body having a conductivity.

The pressing type developing method will be more clearly described with reference to FIG. 2. Referring to FIG. 2, a developing roller 1 is disposed between a toner applying roller 4 for supplying toner and a photosensitive drum 5 for supporting an electrostatic latent image. The developing roller 1, photosensitive drum 5, and toner applying roller 4 are rotated in the direction indicated by an arrow in FIG. 2, so that toner 6 is supplied on a surface of the developing roller 1 by the toner applying roller 4. The toner 6 thus supplied is then adjusted into a uniform thin layer by a layer forming blade 7. In such a state, by rotating the developing roller 1 while bringing it in contact with the photosensitive drum 5, the toner 1 formed into the thin layer on the developing roller 1 is deposited to and adheres on a latent image formed on the photosensitive drum 5, whereby the latent image is visualized. In this figure, reference numeral 8 indicates a transfer portion at which a toner image is transferred on a recording medium such as a paper sheet; and 9 is a cleaning portion at which the toner remaining on the surface of the photosensitive drum 5 after transfer of the toner image is removed by a cleaning blade 10.

In this case, the developing roller 1 is required to be rotated while maintaining close-contact with the photosensitive drum 5. Consequently, as shown in FIG. 1, the developing roller 1 has a structure such an elastic layer 3, which is made from an elastic rubber such as a silicon rubber, NBR or EPDM, or a urethane foam mixed with a conductive agent for giving a conductivity thereto, is formed around an outer periphery of a shaft 2 made from a highly conductive material such as a metal.

Another type developing method has also be proposed in Japanese Patent Laid-open No. Sho 58-116559, wherein a non-magnetic toner formed in a thin layer is supported on a surface of a developing sleeve disposed in proximity to, that. is, not in contact with a latent image support and is flied and supplied on the latent image support, whereby a latent image on the latent image support is developed with the toner. Further, there have been known a developing method using a latent image support being not formed in a drum shape but in a belt shape, and a developing method of forming an image by directly supplying toner from a developing roller onto a recording medium such as a sheet of paper, transparency, or photographic paper. Even in each of these developing methods, a developing roller similar to that described above can be used.

On the other hand, recently, in addition to the so-called monochromatic developing performance necessary for printing only characters, a high gradient is also required to meet a demand for realizing a higher image quality necessary for a photographic image. Consequently, it has been required to design a developing roller allowing a developed amount by toner to be moderately changed depending on a running developing bias. To obtain such a characteristic, it may be considered to design a developing roller in which a resistance of the roller is made high and also a surface resistance of the roller is made high.

In the case where the roller resistance is made high, however, a developing bias is reduced on the basis of a voltage drop due to the roller resistance, failing to obtain a sufficiently developed amount, and at present, such a problem cannot be solved by the related art.

SUMMARY OF THE INVENTION

An object of the present invention is to provide a developing roller capable of obtaining a sufficiently developed amount without occurrence of a reduction in developing bias on the basis of a voltage drop and also sufficiently satisfying a requirement concerning a gradient characteristic, and to provide a developing apparatus using the developing roller.

The inventor has earnestly studied to achieve the above object, and found that in a developing process in which a one-component developer is supported on a surface of a developing roller in the form of a thin layer, and in such a state, the surface of the developing roller is brought in contact with or in proximity to an image forming body such as a latent image support for holding on a surface an electrostatic latent image, to supply the developer on the surface of the image forming body, thereby allowing a visible image to be formed on the surface of the image forming body, it is possible to ensure a sufficiently developed amount without a reduction in developing bias on the basis of a voltage drop and also attaining a high gradient characteristic, by configuring the above developing roller to include an elastic layer whose surface is imparted with a resin component having a high resistivity, wherein a resistance of the roller in a stationary state is larger than a resistance of the roller in a rotational state.

To be more specific, a developing roller satisfying a relationship of R1>R2 where R1 is a resistance of the roller in a stationary state and R2 is a resistance of the roller in a rotational state can be obtained by treating, using a high resistivity resin component, a surface of an elastic layer having an tonically conductivity (inverse number of resistivity) in a medium/high resistivity region of $10^5$ to $10^{10}$ Ωcm. Such a developing roller is allowed to exhibit a high surface resistance and hence to attain a high gradient characteristic, and also to ensure a sufficiently developed amount without a reduction in developing bias on the basis of a voltage drop and hence to attain an output of a high quality image. On the basis of the above knowledge the present invention has been accomplished.

Accordingly, the present invention provides a developing roller, which supports a one-component developer on a surface thereof in the form of a thin layer, and which is brought in contact with or in proximity to an image forming body in such a state, to supply the developer on a surface of the image forming body, thereby allowing a visible image to be formed on the surface of the image forming body, the developing roller including: an elastic layer having an ionically conductivity whose surface is imparted with a resin component ihaving a high resistivity; wherein letting R1 be a resistance of the roller in a stationary state and R2 be a resistance of the roller in a rotational state, a relationship of R1>R2 is established.

The present invention also provides a developing apparatus including: a developing roller, which supports a one-component developer on an outer peripheral surface thereof, and which is brought in contact with or in proximity to a surface of an image forming body in such a state and is rotated, to stick the one-component developer on the surface of the image forming body, thereby allowing a visible image to be formed on the surface of the image forming body; wherein the developing roller is composed of the above-described developing roller of the present invention.

DETAILED DESCRIPTION OF THE PREFERRED EMBODIMENTS

Hereinafter, the present invention will be more fully described.

Figure 1:
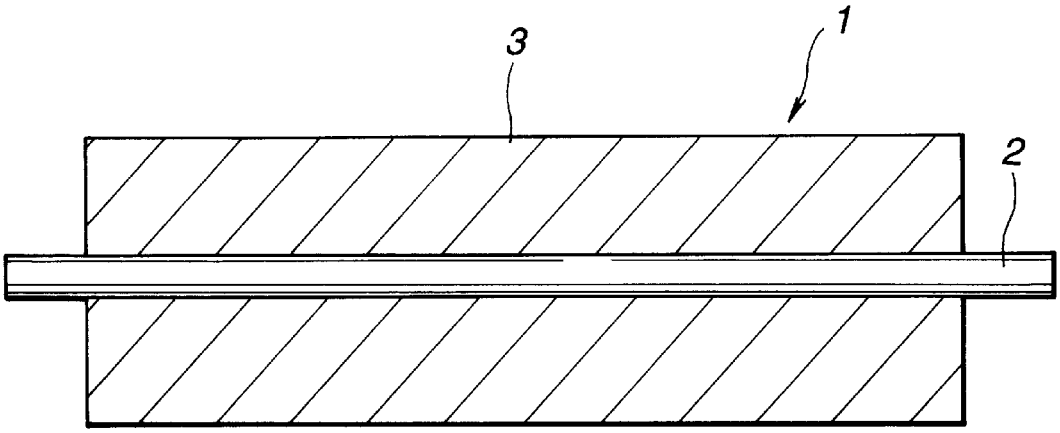
FIG. 1 is a schematic sectional view showing one example of a developing roller of the present invention.

A developing roller of the present invention usually has an elastic layer 3 formed around an outer periphery of a highly conductive shaft 2, like the roller shown in FIG. 1. According to the present invention, a surface of the elastic layer having an ionically conductivity is imparted with a resin component having a high resistivity, to prepare a relationship of R1>R2 where R1 is a resistance of the roller in a stationary state and R2 is a resistance of the roller in the rotational state.

The shaft 2 may be formed of any member insofar as the member has a high conductivity, and in general, the shaft 2 is composed of a solid metal core bar or a metal cylinder formed by hollowing the core bar.

The elastic layer 3 formed around the outer periphery of the shaft 2 is formed of a base material, for example, an elastomer such as a polyurethane or EPDM, a foam material, and a molded resin, which is added with an tonically conductive material such as a sodium perchlorate for adjusting a conductivity (inverse number of resistivity) thereof in a high/medium resistivity region suitable for the developing roller, that is, in a region of $10^5$ to $10^{10}$ Ωcm.

In this case, specific examples of the base materials may include a polyurethane, EPDM, natural rubber, butyl rubber, nitrile rubber, polyisoprene rubber, polybutadiene rubber, silicon rubber, styrene-butadiene rubber, ethylene-propylene rubber, chloroprene rubber, acrylic rubber, and mixtures thereof. A polyurethane and an EPDM are preferably used. In addition, as the base material, there may be preferably used a resin such as a phenol resin, polyester, or polycarbonate.

A polyurethane used as the base material of the elastic layer 3 will be described below. As a polyurethane elastomer or a urethane foam material, any one of types produced in various processes may be used. For example, such a polyurethane can be obtained by a method of adding a sodium perchlorate in a polyurethane prepolymer and crosslinking the prepolymer, or a method of adding an tonically conductive material in a polyol and allowing the polyol to react with a polyisocyanate by a one-shot process.

As a polyhydroxyl compound used for preparation of a polyurethane, there may be used a polyol generally used for producing a soft polyurethane foam or a urethane elastomer, for example, a polyether/polyol having a polyhydroxyl group at its terminal, a polyester/polyol, or a polyether/-polyester/polyol copolymer thereof, and further a general polyol, for example, a polyolefin/polyol such as a polybutadiene/polyol or polyisoprene/polyol or a so-called polymer polyol obtained by polymerization of an ethylene based unsaturated monomer in a polyol. As a pplyisocyanate compound, there may be used a polyisocyanate generally used for producing a soft polyurethane foam or a urethane elastomer, for example, tolylene diisocyanate (TDI), crude TDI, 4,4-diphenylmethanediisocyanate (MDI), crude MDI, an aliphatic polyisocyanate having the carbon number of 2 to 18, an alicyclic polyisocyanate having the carbon number of 4 to 15, or a mixture or modified material thereof, for example, a prepolymer obtained by partial reaction between a polyisocyanate and a polyol.

On the other hand, the EPDM is a ternary polymer containing ethylene, propylene and a third component. As the third component, while not exclusively, there may be preferably used dicyclopentadiene, ethylidenenorbornene, or 1,4-hexadiene. The mixing ratio of ethylene, propylene and the third component may be preferably, while not exclusively, set such that the content of ethylene is in a range of 5 to 95 wt %; the content of propylene is in a range of 5 to 95 wt %; and the content of the third component is in a range of 0 to 50 in iodine number. In addition, two kinds of EPDMs different in iodine number may be mixed. The EPDM may be blended with either or both of a silicone rubber and a silicon modified EPDM. In this case, each of the silicone rubber and the silicone modified EPDM may be added to the EPDM in an amount of 5 to 80 parts by weight on the basis of 100 parts by weight of the EPDM. The above-described silicone modified EPDM means a hybrid rubber in which a bonding force between both polymers of the EPDM and silicone is increased through a silanol compound and siloxane.

A crosslinking agent or a vulcanizing agent may be added to the elastic layer for crosslinking it into a rubber-like material. In each of crosslinking by an organic peroxide and crosslinking by sulfur, a vulcanizing assistant, a vulcanizing accelerator, a vulcanizing acceleration assistant, or a vulcanizing retarding agent may be used. The elastic layer may be further added with an additive generally used for a rubber compound agent, such as a peptizer, foaming agent, plasticizer, softening agent, tackifier, surface tack eliminator, separating agent, mold releasing agent, extender, or coloring agent.

In the elastic layer 3, a charge controlling agent such as nigrosine, triaminophenylmethane, or cation dye, or fine particles of a silicon resin, silicon rubber, or nylon may be added for controlling an electrified amount of toner on the surface of the elastic layer 3. In this case, the amount of the additive added may be preferably set such that the added amount of the charge controlling agent is in a range of 1 to 5 parts by weight and the added amount of the fine particles is in a range of 1 to 10 parts by weight on the basis of 100 parts by weight of a base material of the elastic layer 3.

Specific examples of the tonically conductive materials, as the conductive materials each being adapted to give an tonically conductivity to the elastic layer 3, may include ammonium salts, for example, a perchlorate, chlorate, hydrochloride, bromate, iodate, hydroborofluoride, sulfate, ethylsulfate, carbonate, and sulfonate of tetraethylammonium, tetrabutylammonium, lauryltrimethylammonium, stearyltri-methylammonium, octadecyltrimethylammonium, dodecyltrimethylammonium, hexadecyltrimethylammonium, benzyltrimethyl-ammonium, and denaturated fatty acid dimethylethylammonium; and a perchlorate, chlorate, hydrochloride, bromate, iodate, hydroborofluoride, trifluoromethylsulfate, and sulfonate of alkali metals or alkali earth metals such as lithium, sodium, calcium and magnesium. These ionically conductive materials can be usually mixed in an amount of 0.01 to 1 part by weight, preferably, in a range of 0.05 to 0.5 part by weight on the basis of 100 parts by weight of the base material of the elastic layer 3.

Here, as the conductive material, the above-described tonically conductive material may be used because it can easily, uniformly adjust the resistivity of the elastic layer 3 in the medium/high resistivity region of $10^5$ to $10^{10}$ Ωcm, particularly, $10^5$ to $10^8$ Ωcm, and the resistance characteristic of the roller can be effectively adjusted to satisfy the relationship of R1>R2 where R1 is a resistance of the roller in a stationary state and R2 is a resistance of the roller in a rotational state by combination of the elastic layer in the medium/high resistivity region containing such an tonically conductive material and a high resistivity resin component (which will be described later). In this case, an electronically conductive material can be added in a suitable amount, as needed. Specific examples of the electronically conductive materials may include powders of a conductive carbon material such as Ketchen Black EC or acetylene black; a rubber carbon material such as SAF, ISAF, HAF, FEF, GPF, SRF, FT, and MT; carbon for color (ink) subjected to oxidation or the like; pyrolytic carbon; natural graphite; synthetic graphite; a metal and metal oxide such as antimony doped tin oxide, titanium oxide, zinc oxide, nickel, copper, silver, and germanium; and a conductive polymer such as a polyaniline, polypyrrol, or polyacetylene.

According to the present invention, a resistivity of the elastic layer 3 may be, while not exclusively, set at a value in a range of $10^5$ to $10^{10}$ Ωcm, preferably, in a range of $10^6$ to $10^8$ Ωcm by mixing of the above-described conductive material. When the resistivity is less than $10^5$ Ωcm, there may occur leakage in the case where pin-hole defects are present in an image forming body such as a photosensitive body, leading to a poor image. When it is more than $10^{10}$ Ωcm, there may occur an inconvenience that a sufficient image density cannot be obtained because of the lack of an effective developing bias.

A hardness of the elastic layer 3 may be, while not exclusively, set at a value in a range of 60° or less, preferably, in a range of 25 to 55° in JIS-A scale in the case where the developing roller is brought in contact with a latent image support such as a photosensitive drum. In this case, when the hardness is more than 60°, the contact area with the photosensitive drum or the like is made smaller, failing to perform a preferable development. When the hardness is excessively low, a compression set becomes larger, so that in the case where the developing roller is deformed or decentered from some reasons, there occurs uneven image density. Accordingly, even in the case where the hardness of the elastic layer is set at a low value, it is desired to make the compression set as small as 20% or less.

The surface roughness (ten-point surface roughness Rz specified under JIS) of the developing roller of the present invention may be, while not exclusively, set at a value in a range of 15 μm or less, preferably, in a range of 1 to 10 μm. When the surface roughness is more than 15 μm, uniformity in thickness of a layer of a one-component developer (toner) or in electrification may be lost. By setting the surface roughness at a value of 15 μm or less, it is possible to improve adhesiveness of toner, and also certainly prevent degradation of an image due to wear of the roller in long-term use.

The developing roller of the present invention is characterized in that a surface portion of the elastic layer 3 is imparted with a resin component having a high resistivity. The high resistivity resin component may be, while not exclusively, configured to exhibit a property of not contaminating a latent image support such as a photosensitive drum. Specific examples of the high resistivity resin components may include a urea resin, melamine resin, alkyd resin, phenol/silicon-denaturated alkyd resin, oil free alkyd resin, acrylic resin, silicon resin, fluorocarbon resin, phenol resin, polyamide resin, epoxy resin, polyester resin, maleic resin, and urethane resin. In particular, in terms of film formation characteristic and adhesive characteristic, there may be preferably used one kind or two or more kinds selected from a group consisting of a urea resin, melamine resin, silicon resin, phenol resin, alkyd resin, denaturated alkyd resin, oil free alkyd resin, and acrylic resin.

The high resistivity resin component may be higher in resistivity than the elastic layer 3. Preferably, it may be substantially non-conductive. The resistivity of the high resistivity resin component may be in a range of $10^6$ to $10^{15}$ Ωcm, preferably, in a range of about $10^8$ to $10^{15}$ Ωcm. A conductive material may be added to the high resistivity resin component insofar as the resin component finally exhibits a resistivity value in the above range. In a normal application, a surface portion of the elastic layer 3 is desired not to contain a conductive powder of carbon or the like for obtaining a preferable toner electrification characteristic; however, in the case of using the roller for a high speed printer, the surface portion of the elastic layer 3 is desired to contain a conductive powder for effectively preventing occurrence of a low pressure fogged image. As a result, it may be suitably determined in consideration of the application and the purpose of the developing roller whether or not a powder of a conductive material such as carbon is added to the resin component.

Such a high resistivity resin component may be preferably imparted on the surface of the elastic layer 3 by treating the surface of the elastic layer 3 of the roller with a resin solution containing the high resistivity resin component. In this case, the surface-treatment can be performed by spraying, roll-coating, or dipping the previously prepared region solution. For example, the surface-treatment by dipping is performed by dipping the elastic layer 3 in a resin solution having the resin concentration in a range of 1 to 30%, generally, at room temperature for 5 sec to 5 min, preferably, for 10 sec to 1 min, followed by pulling up and drying of the elastic layer 3. In the case of surface-treatment by spraying, the resin concentration in the resin solution may be set at a value higher than that in surface-treatment by dipping, for example, in a range of 10 to 50%. In addition, as a solvent for preparation of the resin solution, there may be any kind of solvent insofar as it can dissolve the above resin, and generally, there may be preferably used a lower alcohol such as methanol, ethanol, or isopropanol, a ketone such as acetone, methylethylketone or cyclohexanone, or toluene or xylene.

The friction of the roller surface can be reduced by the above surface-treatment using the high resistivity resin component. However, to further reduce friction, an additive capable of reducing the friction without contaminating a photosensitive body and without reducing uniformity of surface-treatment may be added in the resin component. The additive, may be preferably a silicone resin, a powder of a silicone resin, a fluorine based or silicon based surface-active agent, a silane coupling agent, or a powder of silica.

Specific examples of the above silicone resins may include a solvent-soluble type, for example, methylsilicon polymer, methylphenylsilicon polymer, and a denaturated resin, thereof such as a silicon-epoxy block copolymer.

Specific examples of powders of silicone resins may include fine powders of a methylsilicon or methylphenyl-silicone polymer, and amino based denaturated silicone polymer. In this case, there may be preferably used a spherical or unshaped powder having an average particle size of 0.1 to 100 $\mu$m.

Specific examples of the fluorine based surface-active agents may include an ionic type in which alkyl fluoride is bonded with carboxylic acid, carbonate, sulfonate or the like; a nonionic type in which alkyl fluoride is bonded with alcohol, ether or the like; and a high molecular type such as a polymer or copolymer containing alkyl fluoride at a side chain or a main chain thereof.

Specific examples of the silicone based surface-active agents may include a bonded type such as general siloxane oxyethylene in which methylsilicon is boned with a hydrophilic or lipophilic segment; and a high molecular type such as a copolymer of methylsilicon and an acrylic segment.

Specific examples of the silane coupling agents may include a general silane coupling agent; and silane containing an amino group, isocyanate group or vinyl group at a terminal thereof.

These additives may be added singly or in combination of two kinds or more. In addition, a fluorocarbon resin may be also effectively used as a friction reducing agent. The friction reducing agent may be added in an amount of 1 to 100 parts by weight, preferably, in a range of 10 to 75 parts by weight on the basis of 100 parts by weight of the resin component. In the case of using an tonically conductive material as the conductive material when the ionically conductive material is added to the high resistivity resin component, the ionically conductive material may be added in an amount of 0.001 to 1 part by weight on the basis of 100 parts by weight of the resin solution. On the other hand, in the case of using a conductive powder of carbon as the conductive material, the conductive powder may be added in an amount of 1 to 50 parts by weight on the basis of 100 parts by weight of the resin component.

The high resistivity resin component may be imparted on the elastic layer 3 in the form of a film covering the entire surface of the elastic layer 3, in the form of dots in which irregularities on the surface of the elastic layer 3 are buried with the resin component, or in the form in which most of irregularities on the surface of the elastic layer 3 are buried with the resin component and only leading ends of projections of the irregularities are partially exposed. In addition, a thickness of the high resistivity resin component imparted on the elastic layer 3 may be, while not exclusively, in a range of 0.1 to 20 $\mu$m, preferably, in a range of 1 to 10 $\mu$m even when the resin component is imparted in the form of a film.

The developing roller of the present invention is characterized in that a relationship of R1>R2 is given where R1 is a resistance of the roller in a stationary state and R2 is a resistance of the roller in a rotational state by surface-treatment for imparting a high resistivity resin component on the surface of the roller. In this case, it is important that the high resistivity resin component used for the above surface treatment has, as described above, a high resistivity of $10^6$ to $10^{15}$ Ωcm, which is nearly close to that of an insulator. The reason for this is that if the roller surface has a conductivity, a current is liable to flow in the longitudinal direction of the roller, and consequently, in the case where a potential distribution in the longitudinal direction is finely set to give a straight gradient along the longitudinal direction to an image, the potential on the surface of a photosensitive body is disturbed by flow of charges into the photosensitive body or the like, thus failing to obtain a sufficient gradient. On the contrary, by use of a developing roller with a surface portion being nearly insulating, it is possible to accurately develop toner without disturbing the potential on the surface of the photosensitive body, and hence to obtain an image having a high gradient.

For this reason, according to the present invention, a resistivity of a surface portion of the developing roller is made higher by imparting the above high resistivity resin on the surface of the developing roller. In this regard, generally, if the surface resistance of the roller is set at a high value, it fails to obtain a sufficiently developed amount. In an actual developing apparatus, however, it is reasonable that a resistance of the roller upon rotation is taken as a roller resistance because the roller is usually rotated upon developing. From this viewpoint, according to the present invention, the characteristic of a roller resistance is adjusted such that a resistance R1 of the roller in a stationary state is set to be usually higher than a resistance R2 of the roller in a rotational state by the above-described surface-treatment. As a result it is possible to set the resistance R2 of the roller in the rotational state, that is, upon actual development to be usually lower than the resistance R1 of the roller in the stationary state, and hence to actually obtain a sufficiently developed amount.

Figure 3:
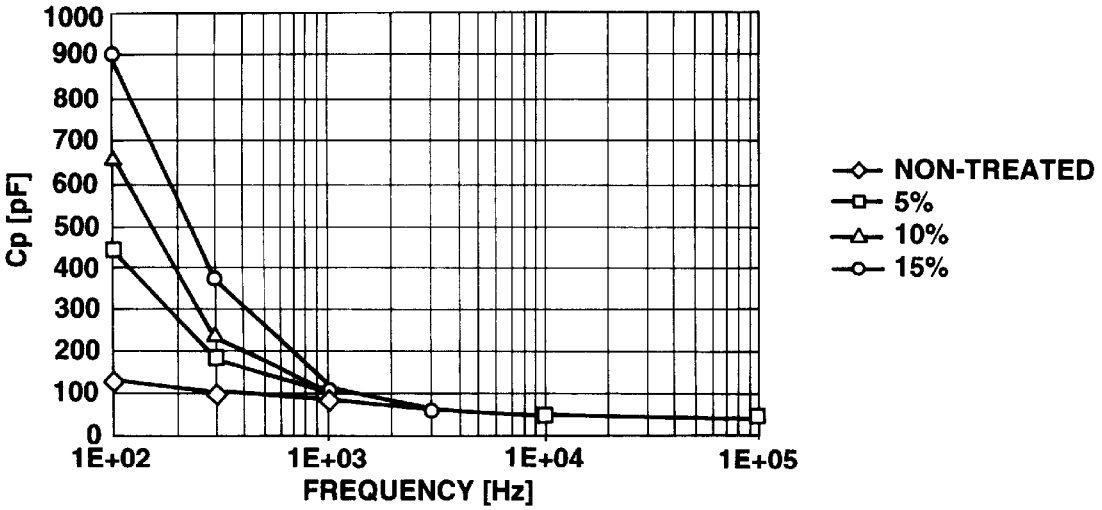
FIG. 3 is a graph showing changes in electrostatic capacity depending on variations in thickness of a high resistivity resin formed on a single elastic layer on the basis of an electrostatic capacity of the single elastic layer.
Figure 4:
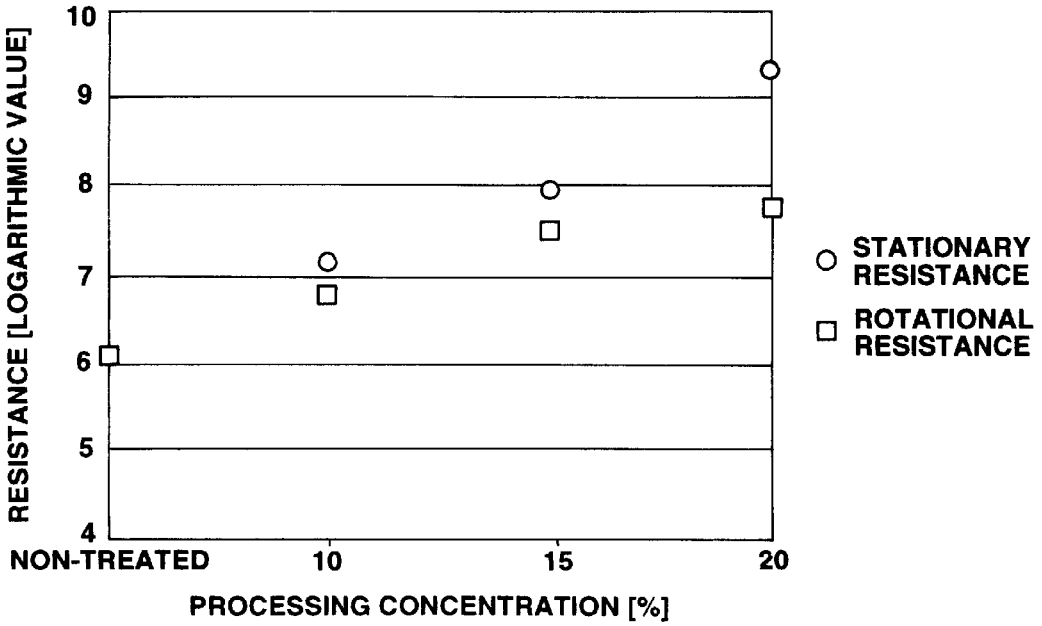
FIG. 4 is a graph showing measured values of a resistance of each of the rollers (which are the same as those used for the test shown in FIG. 3) in a stationary state and a resistance of the roller in a rotational state.

Here, the reason why a roller resistance is changed between in the rotational state of the roller and in the stationary state of the roller will be described. FIG. 3 illustrates changes in electrostatic capacity depending on variations in thickness of a high resistivity resin formed on a single elastic layer on the basis of an electrostatic capacity of the single elastic layer. In samples used for this test, a resin solution containing a high resistivity resin is prepared in the same manner as that in Example 1 (which will be described later). As is apparent from FIG. 3, the electrostatic capacity becomes larger as the thickness of the resin film becomes larger. FIG. 4 slots measured values of a resistance of each of the rollers (which are the same as those used for the test shown in FIG. 3) in the stationary state and a resistance of the roller in the rotational state. As is apparent from FIG. 4, the resistance of each roller in the rotational state is lower than the resistance of the roller in the stationary state, and a difference between the resistances of the roller in the rotational and stationary states becomes larger as the electrostatic capacity of the roller becomes larger. In addition, the dependency of a rotational speed on a resistance of the roller is little observed in a practical rotational speed range. (80 rpm).

From these results, the following model can be constricted. That is, a current value observed upon applying a voltage between an electrode and a shaft of the roller is generally equivalent to the sum of a current value flowing between the electrode and the shaft of the roller and the amount of charges consumed for electrifying charges based on the electrostatic capacity of the roller. In this case, when the roller is in the stationary state, the charges based on the electrostatic capacity are immediately saturated, and thereafter, only the current value steadily flowing through the roller resistance is observed. On the other hand, when the roller is in the rotational state, since a new surface of the roller is usually brought in contact with the electrode, it is required to usually electrify charges corresponding to those based on the electrostatic capacity, which is steadily observed as a current value. This results in a difference in current amount between in the stationary state and in the rotational state, whereby the resistance of the roller in the rotational state becomes lower than the resistance of the roller in the stationary state as described above.

Figure 2:
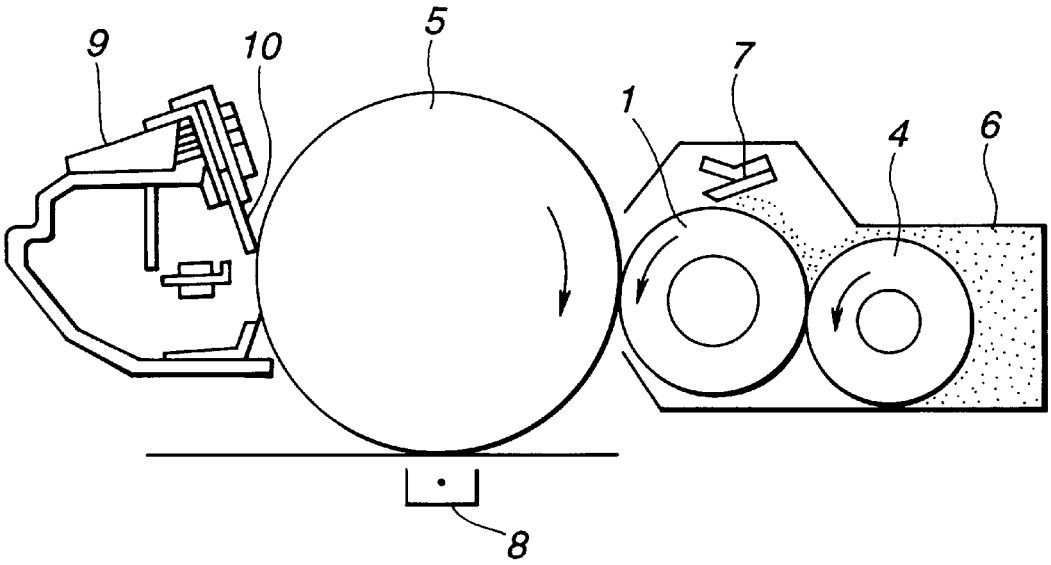
FIG. 2 is a schematic sectional view showing one example of a developing apparatus of the present invention.

The developing roller of the present invention can be assembled in a usual developing apparatus using a one-component developer. Specifically, as shown in FIG. 2, a developing roller 1 of the present invention is disposed between a toner applying roller 4 for supplying toner and a photosensitive drum 5 for supporting an electrostatic latent image in such a manner as to be brought in contact with or in proximity to the photosensitive drum 5. Toner 6 is supplied from the toner applying roller 4 onto the developing roller 1 and is adjusted into a uniform thin film by a film forming blade 7, and the toner is supplied from the thin layer onto the photosensitive drum 5 and stuck on an electrostatic latent image of the photosensitive drum 5, thereby visualizing the latent image. It should be noted that the details of FIG. 2 have been already explained in the paragraph concerning the related art, and therefore, that prior explanation is omitted.

The developing roller of the present invention is suitably used for a developing process, as shown in FIG. 2, in which an electrostatic latent image supported on a surface of the photosensitive drum 5 is visualized with a one-component developer. In the developing process using the developing roller of the present invention, however, the image forming body for forming a visible image using a developer supplied from the developing roller of the present invention is not limited to the photosensitive drum, but it may include a latent image support formed not in a drum shape but in a belt shape. Further, the developing roller of the present invention can be suitably applied to a developing process in which a developer is directly supplied onto a recording medium such as a sheet of paper, transparency or photographic paper, thereby allowing a visible image to be formed on the sheet. For example, the developing roller of the present invention can be suitably used as a developing roller of a mechanism disclosed in Japanese Patent Laid-open No. Hei 8-129293. In this mechanism, the developing roller for supporting a developer is proximity to a front surface side of a sheet of paper or transparency in a state in which a back electrode roller is disposed on a back surface side of the sheet, and the developer supported on the developing roller is flied to the back electrode roller while controlling the developer by an aperture electrode, to supply the developer on the sheet disposed between the back electrode roller and the developing roller, thereby allowing a visible image to be formed on the paper. Even in the above mechanism, by use of the developing roller of the present invention, it is possible to obtain an excellent gradient.

For the one-component developer, a non-magnetic one-component developer; is preferred however, there can be also used a magnetic one-component developer. For example, the developing roller and the developing apparatus of the present invention can be suitably used for monochromatic printing using a magnetic one-component developer.

EXAMPLE

The present invention will be more clearly described by way of, while not limited thereto, the following inventive examples and comparative examples. In addition, in the following examples, surface-treatment was performed by dipping a sample roller in a resin solution at room temperature for 30 sec.

Example 1

Urethane denaturated MDI of 25.0 parts by weight, 1,4-butanediol of 2.5 parts by weight, dibutyltinlaurate of 0.01 part by weight, and sodium perchlorate of 0.15 part by weight were mixed with polyether/polyol (molecular weight: 5,000, prepared by polymerization of glycerine, propylene-oxide and ethylene oxide) of 100 parts by weight, to prepare a mixture. The mixture was poured in a mold inserted with a metal shaft and heated at 110° C., and was then hardened for 2 hr, to form a conductive elastic layer composed of a polyurethane around an outer periphery of the metal shaft. A surface of the conductive member, thus obtained, including the conductive elastic layer around the outer periphery of the metal shaft was polished in a dry state into a roller shape.

For this roller made from the polyether based urethane resin, a resistance value thereof was $10^6$ Ω and a surface roughness thereof (ten-point average roughness Rz specified under JIS) was 7.0 μm.

A resin solution was prepared by mixing an oil free alkyd resin and a melamine resin (Beckolite M-6402 and Super Beckamin L110 respectively, produced by Dainippon Ink & Chemicals, Incorporated) at a mixing ratio of 4:1 and dissolving the mixed resin in methylethylketone at a resin concentration of 15 wt %. The surface of the above-described polyether based urethane roller was subjected to surface-treatment using such a resin solution, to obtain a developing roller.

Two pieces of electrodes each having a width of 1 cm were disposed in such a manner as to be separated from each other at a distance of 5 cm, and the above-described roller was placed on these electrodes. Then, a surface resistance of the roller was measured by bringing the roller in presscontact with the electrodes with a load of 500 g applied on each end of the roller (total load: 1,000 g) and applying a voltage of 100 V between both the electrodes. As a result, it was found that the surface resistance of the roller was $8\times10^8$ Ω.

Example 2

The procedure in Example 1 was repeated except that surface-treatment was performed using a resin solution in which a resol-type phenol resin (PR50232, produced by Sumitomo Durez Co., Ltd.) was dissolved in methylethylketone at a resin concentration of 15 wt %, to obtain a developing roller. A surface resistance of the roller was then measured in accordance with the same manner as that in Example 1. As a result, it was found that the surface resistance of the roller was $3\times10^8$ Ω.

Comparative Example 1

The procedure in Example 1 was repeated except that surface treatment was performed using a resin solution containing the resin in which carbon (Printex XE2, produced by Degussa Japan Co., Ltd.) as a conductive agent was added in an amount of 10 parts by weight, to obtain a developing roller. A surface resistance of the roller was then measured in accordance with the same manner as in Example 1. As a result, it was found that the surface resistance of the roller was $10^4$ Ω. This means that the surface of the roller is sufficiently made conductive.

Comparative Example 2

The procedure in Example 1 was repeated except that upon formation of the roller, the added amount of the jonically conductive material was reduced into a value of 0.001 part by weight to increase the roller resistance and the surface-treatment was not performed, to obtain a developing roller. A surface resistance of the roller was as high as $6\times10^7$ Ω.

Comparative Example 3

The procedure in Example 1 was repeated except that upon preparation of the polyether based urethane roller, the conductive agent for giving conductivity was changed from the ionically conductive material into carbon black (Denka Black, produced by Denki Kagaku Kogyo Kabushiki Kaisha) in an amount of 2.7 parts by weight and also surface-treatment for the roller was not performed, to obtain a developing roller. A surface resistance of the roller was $10^4$ Ω.

The developing rollers in the above-described inventive examples and the comparative examples were subjected to the following characteristic tests. The results are shown in Table 1.

(1) Measurement of Resistance of Roller in Rotational State

Figure 5:
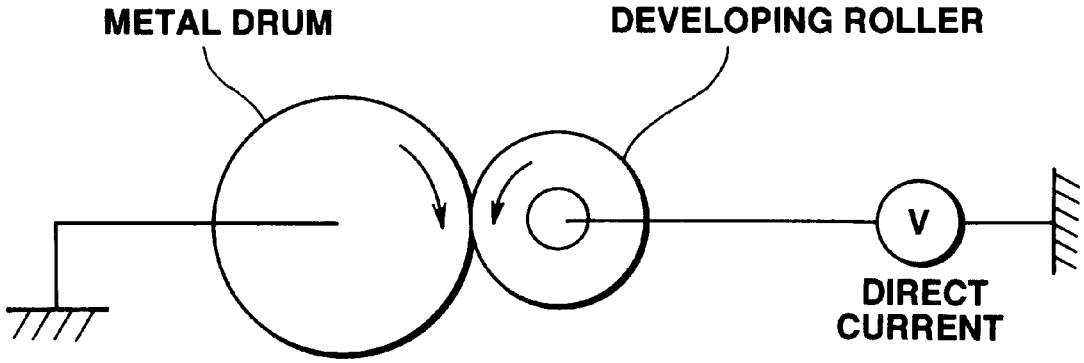
FIG. 5 is a schematic view showing an apparatus used for measurement of surface resistances of rollers in inventive examples and comparative examples.

The measurement was performed using a measurement apparatus shown in FIG. 5. The developing roller was pushed on an electrode roller by applying a load of 500 g on each axial end of the roller (total load: 1,000 g), and was rotated along with rotation of the electrode roller at 30 rpm. In such a state, a voltage of 100 V was applied from a dc voltage power between a shaft of the developing roller and the electrode roller, and a current value in this state was measured. Thus, a resistance value was calculated on the basis of the current value measured after current-carrying for 5 sec.

(2) Measurement of Resistance of Roller in Stationary State

The measurement was performed using the measurement apparatus shown in FIG. 5. The developing roller was pushed on the electrode roller in the same manner as that for measurement of the resistance of a roller in the rotational state, and a current value was measured in a state in which both the rollers were not rotated. Then, a resistance value was similarly calculated on the basis of the measured current value.

(3) Evaluation of Image

A printing test was carried out using a developing apparatus shown in FIG. 2 in which each developing roller was assembled. In this printing test, the following items were evaluated.

[Black Concentration]: A gray image was outputted, and an optical density of the image was measured using a tester (Macbeth 610C).

[Fogged Image]: Toner stuck on a portion of a photosensitive body except for a printing portion was transferred on a tape, and an optical density of the toner was measured using the tester (Macbeth 610C).

[Black Tracking Characteristic]: A gray image was printed longer in the printing direction, and a difference in density between front and rear ends of the image was visually determined.

[Ghost]: A half-tone solid image was printed directly after printing of a character pattern, and the presence or absence of an after image of the forward character was visually observed.

[Gradient]: A photographic image was printed, and a gradient of the image was visually determined.

As is apparent from Table 1, in each of the developing rollers prepared in Examples 1 and 2, in which the resistance characteristic of the roller was adjusted to satisfy the relationship of R1>R2 (R1 is the resistance of the roller in the stationary state, and R2 is the resistance of the roller in the rotational state) by imparting the high resistivity resin component on the roller surface, an image having a sufficiently high density and an excellent gradient was obtained. On the contrary, in each of the developing rollers prepared in Comparative Example 1 in which R1=R2 and Comparative Example 3 in which R1<R2, an image obtained was very monochromatic; the repeatability of characters was excellent but the repeatability of gradient was significantly poor; a photographic image outputted was crushed; and the repeatability of half-tone was poor. Further, in the developing roller prepared in Comparative Example 2, in which the resistivity of the elastic layer was adjusted using sodium perchlorate as the ionically conductive material and any resin component was not imparted on the roller surface, an image obtained was poor in black tracking characteristic, and a background fogged image and a ghost were also observed.

As described above, according to the developing roller of the present invention and the developing apparatus using the developing roller, it is possible to obtain a sufficiently developed amount without a reduction in developing bias on the basis of a voltage drop, and to obtain an image capable of sufficiently satisfying a requirement concerning a gradient characteristic.

TABLE 1

| | Inventive Examples | | Comparative Examples | | |
|---|---|---|---|---|---|
| | 1 | 2 | 1 | 2 | 3 |
| | Roller Characteristic Values | | | | |
| elastic layer | ionic (*1) | ionic (*1) | ionic (*1) | ionic (*1) | C/B (*2) |
| surface resin | alkyd melamine | phenol | alkyd melamine | absence | absence |
| surface roughness (μm) | 7.4 | 9.2 | 7.7 | 7.5 | 6.8 |
| stationary resistance R1 (Ω) | $1 \times 10^9$ | $3 \times 10^8$ | $7 \times 10^5$ | $2 \times 10^9$ | $1 \times 10^5$ |
| rotational resistance R2 (Ω) | $8 \times 10^7$ | $3 \times 10^7$ | $7 \times 10^5$ | $2 \times 10^9$ | $2 \times 10^5$ |
| resistance of single elastic layer (Ω) | $2 \times 10^6$ | $2 \times 10^6$ | $2 \times 10^6$ | $2 \times 10^9$ | $1 \times 10^4$ |
| surface resistance (Ω) | $8 \times 10^8$ | $3 \times 10^8$ | $1 \times 10^4$ | $6 \times 10^7$ | $1 \times 10^4$ |
| | Evaluation Result of Image | | | | |
| Black density | 1.39 | 1.41 | 1.42 | 1.10 | 1.42 |
| Fogged image | 0.10 | 0.11 | 0.12 | 0.32 | 0.13 |
| Black tracking characteristic | ○ | ○ | ○ | x | ○ |
| Ghost | ○ | ○ | ○ | x | ○ |
| Gradient | ◎ | ◎ | x (*3) | x (*4) | x (*3) |

*1) ionic = ionically conductive agent
*2) C/B = conductive material (carbon black)
*3) image, crushed,
*4) density, thin

What is claimed is:

1. A developing roller, which supports a one-component developer on a surface thereof in the form of a thin layer, and which is brought in contact with or in proximity to an image forming body in such a state, to supply said developer on a surface of said image forming body, thereby allowing a visible image to be formed on the surface of said image forming body, said developing roller comprising:

an elastic layer having an tonically conductivity whose surface is imparted with a resin component having a high resistivity;

wherein letting R1 be a resistance of said roller in a stationary state and R2 be a resistance of said roller in a rotational state, a relationship of R1>R2 is established.

2. A developing roller according to claim 1, wherein said elastic layer contains an ionically conductive material.

3. A developing roller according to claim 1, wherein said resin component having a high resistivity is a resin having a resistivity of $10^8$ to $10^{15}$ Ωcm.

4. A developing roller according to claim 1, wherein said resin component having a high resistivity is a resin component containing at least one kind of material selected from a group consisting of a urea resin, a melamine resin, a silicone resin, a phenol resin, an alkyd resin, a denaturated alkyd resin, an oil free alkyd resin, and an acrylic resin.

5. A developing roller according to claim 1, wherein said elastic layer has a resistivity of $10^5$ to $10^{10}$ Ωcm.

6. A developing apparatus comprising:

a developing roller, which supports a one-component developer on an outer peripheral surface thereof, and which is brought in contact with or in proximity to a surface of an image forming body in such a state and is rotated, to stick said one-component developer on the surface of said image forming body, thereby allowing a visible image to be formed on the surface of said image forming body;

wherein said developing roller is a developing roller described in any one of claims 1 to 4.

7. A developing roller, which supports a one-component developer on a surface thereof in the form of a thin layer, and which is brought in contact with or in proximity to an image forming body in such a state, to supply said developer on a surface of said image forming body, thereby allowing a visible image to be formed on the surface of said image forming body, said developing roller comprising:

an elastic layer having an ionically conductivity and a resistivity of $10^5$ to $10^{10}$ Ωcm whose surface is imparted with a resin component having a high resistivity by surface treating said elastic layer with a solution containing said resin component, wherein R1 is a resistance of said roller in a stationary state and R2 is a resistance of said roller in a rotational state, such a relationship of R1>R2 is established.

8. A developing roller according to claim 7, wherein said high resistivity resin component is imparted on the elastic layer in the form of a material selected from the group consisting of a film covering the entire surface of the elastic layer, of dots in which irregularities on the surface of the elastic layer are buried with the resin component, and irregularities on the surface of the elastic layer which are buried with the resin component and only leading ends of projections of the irregularities are partially exposed.

9. A developing roller according to claim 7, wherein said high resistivity resin component is imparted on the elastic layer in the form of a film covering the entire surface of the elastic layer at a thickness of 0.1 to 20 μm.

10. A developing roller according to claim 7, wherein said resin component having high resistivity is a resin having a resistivity of $10^8$ to $10^{15}$ Ωcm.

11. A developing roller according to claim 7, wherein said resin component having a high resistivity is a resin component containing at least one type of material selected from a group consisting of a urea resin, a melamine resin, a silicone resin, a phenol resin, an alkyd resin, a denaturated alkyd resin, an oil free alkyd resin, and an acrylic resin.

12. A developing roller according to claim 7, wherein said elastic layer contains an ionically conductive material.

13. A developing roller according to claim 7, wherein said solution contains a friction reducing agent selected from the group consisting of a solvent-soluble silicone resin, a powder of a silicone resin, a fluorine based or silicone based surface-active agent, a silane coupling agent, and a powder of silica.

14. A developing apparatus comprising:

a developing roller, which supports a one-component developer on an outer peripheral surface thereof, and which is brought in contact with or in proximity to a surface of an image forming body in such a state and is rotated, to stick said one-component developer on the surface of said image forming body, thereby allowing a visible image to be formed on the surface of said image forming body;

wherein said developing roller comprises:

an elastic layer having an ionically conductivity and a resistivity of $10^5$ to $10^{10}$ Ωcm whose surface is imparted with a resin component having a high resistivity by surface treating said elastic layer with a solution containing said resin component, wherein R1 is a resistance of said roller in a stationary state and R2 is a resistance of said roller in a rotational state, such a relationship of R1>R2 is established.

15. A developing roller, which supports one-component developer on a surface thereof in the form of a thin layer, and which is brought in contact with or in proximity to an image forming body in such a state, to supply said developer on a surface of said image forming body, thereby allowing a visible image to be formed on the surface of said image forming body, said developing roller comprising:

an elastic layer having an ionically conductivity and a resistivity of $10^5$ to $10^{10}$ Ωcm whose surface is imparted with a resin component having a high resistivity of $10^8$ to $10^{15}$ Ωcm by surface treating said elastic layer with a solution containing said high resistivity resin component, wherein said high resistivity resin component is imparted on the elastic layer in the form of a material selected from the group consisting of a film covering the entire surface of the elastic layer, dots in which irregularities on the surface of the elastic layer are buried with the resin component, and irregularities on the surface of the elastic layer which are buried with the resin component and only leading ends of projections of the irregularities are partially exposed, wherein when R1 is a resistance of said roller in a stationary state and R2 is a resistance of said roller in a rotational state, a relationship of R1>R2 is established.

16. A developing roller according to claim 15, wherein said high resistivity resin component is imparted on the elastic layer in the form of a film covering the entire surface of the elastic layer at a thickness of 0.1 to 20 μm.

17. A developing roller according to claim 15, wherein said resin component having a high resistivity is a resin component at least one type of material selected from a group consisting of a urea resin, a melamine resin, a silicone resin, a phenol resin, an alkyd resin, a denaturated alkyd resin, an oil free alkyd resin, and an acrylic resin.

18. A developing roller according to claim 15, wherein said solution contains a friction reducing agent selected from the group consisting of a solvent-soluble silicone resin, a powder of a silicone resin, a fluorine based or silicone based surface-active agent, a silane coupling agent, and a powder of silica.

19. A developing roller according to claim 15, wherein said elastic layer contains an ionically conductive material.

20. A developing apparatus comprising:

a developing roller, which supports a one-component developer on an outer peripheral surface thereof, and which is brought in contact with or in proximity to a surface of an image forming body in such a sate and is rotated, to stick said one-component developer on the surface of said image forming body, thereby allowing a visible image to be formed on the surface of said image forming body;

wherein said developing roller comprises:

an elastic layer having an ionically conductivity and a resistivity of $10^5$ to $10^{10}$ Ωcm whose surface is imparted with a resin component having a high resistivity of $10^8$ to $10^{15}$ Ωcm by surface treating said elastic layer with a solution containing said high resistivity resin component, wherein said high resistivity resin component is imparted on the elastic layer in the form of a material selected from the group consisting of a film covering the entire surface of the elastic layer, dots in which irregularities on the surface of the elastic layer are buried with the resin component, and irregularities on the surface of the elastic layer which are buried with the resin component and only leading ends of projections of the irregularities are partially exposed, wherein when R1 is a resistance of said roller in a stationary state and R2 is a resistance of said roller in a rotational state, a relationship of R1>R is established.

* * * * *